US008204410B2

(12) United States Patent
Yamazaki et al.

(10) Patent No.: US 8,204,410 B2
(45) Date of Patent: Jun. 19, 2012

(54) DEVELOPER CARTRIDGE, DEVELOPING DEVICE, PROCESS CARTRIDGE AND IMAGE FORMING APPARATUS

(75) Inventors: Ryuya Yamazaki, Nagoya (JP); Susumu Sakuma, Kasugai (JP); Takeyuki Takagi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 870 days.

(21) Appl. No.: 12/210,286

(22) Filed: Sep. 15, 2008

(65) Prior Publication Data

US 2009/0087226 A1 Apr. 2, 2009

(30) Foreign Application Priority Data

Oct. 2, 2007 (JP) ..... 2007-258572

(51) Int. Cl.
*G03G 15/08* (2006.01)

(52) U.S. Cl. ..... 399/263

(58) Field of Classification Search ..... 399/263, 399/254–256, 262
See application file for complete search history.

(56) References Cited

U.S. PATENT DOCUMENTS

| | | | | |
|---|---|---|---|---|
| 5,867,756 | A | 2/1999 | Suzuki et al. | |
| 6,456,810 | B1 * | 9/2002 | Deguchi et al. | 399/254 |
| 7,742,726 | B2 * | 6/2010 | Mase et al. | 399/263 |
| 7,881,633 | B2 * | 2/2011 | Sakuma | 399/106 |
| 2007/0071503 | A1 | 3/2007 | Sato | |
| 2007/0189811 | A1 * | 8/2007 | Sato | 399/254 |
| 2007/0196135 | A1 * | 8/2007 | Fukuta | 399/254 |
| 2008/0124119 | A1 * | 5/2008 | Oda | 399/120 |
| 2008/0240790 | A1 * | 10/2008 | Nishiyama et al. | 399/254 |
| 2009/0087222 | A1 * | 4/2009 | Mase et al. | 399/255 |
| 2009/0087227 | A1 * | 4/2009 | Takagi et al. | 399/263 |

FOREIGN PATENT DOCUMENTS

| | | |
|---|---|---|
| JP | 06-019309 | 1/1994 |
| JP | 09-319201 | 12/1997 |
| JP | 09-319202 | 12/1997 |
| JP | 2000-242069 | 9/2000 |
| JP | 2007-086325 | 4/2007 |

* cited by examiner

*Primary Examiner* — David Gray
*Assistant Examiner* — Rodney Bonnette
(74) *Attorney, Agent, or Firm* — Banner & Witcoff, Ltd.

(57) ABSTRACT

A developer cartridge includes a housing attachable to and detachable from a developing device and accommodating developer and an agitator agitating the developer in the housing and supplying the developer to the developing device through a supply opening of the housing. The agitator includes a rotation shaft, a support plate, a delivery agitation blade supported by the support plate and passing through a position opposing the supply opening along an inner surface of the housing by rotation of the rotation shaft, an entire width of a first end portion of the delivery agitation blade being supported by a distal end portion of the support plate, and an oblique agitation blade erected from a surface of the support plate and oblique to the rotation shaft in order to move the developer in an axial direction of the rotation shaft toward the supply opening.

10 Claims, 14 Drawing Sheets

DEVELOPER CARTRIDGE, DEVELOPING DEVICE, PROCESS CARTRIDGE AND IMAGE FORMING APPARATUS

CROSS-REFERENCE TO RELATED APPLICATIONS

This application claims priority from Japanese Patent Application No. 2007-258572 filed on Oct. 2, 2007, the entire subject matter of which is incorporated herein by reference.

TECHNICAL FIELD

The present invention relates to a developer cartridge having a supply opening for supplying developer in a cartridge to a developing chamber.

BACKGROUND

An image processing apparatus such as a laser printer is provided with a photosensitive drum having electrostatic latent images formed thereon, a process cartridge having a developing roller for supplying developer to the photosensitive drum and a developer cartridge having developer accommodated therein. For example, JP-A-9-319202 discloses an image forming apparatus including a supply opening for supplying developer in a developer cartridge to a developing chamber, a developer cartridge having formed therein a return opening for returning developer from the developing chamber to the inside of the developer cartridge, an agitator having blades for agitating the interior of the developer cartridge and an auger capable of conveying developer within the developing chamber at a supply opening side toward a return opening side. In the related developer cartridge, the developer agitated by the rotation of the agitator is circulated in such a manner that after it is discharged through the supply opening to the developing chamber, it is conveyed toward the return opening side by the auger and then returned through the return opening to the inside of the developer cartridge. Therefore, fresh developer can be supplied from the cartridge.

SUMMARY

Aspects of the present invention provide a developer cartridge capable of supplying a sufficient amount of developer through a supply opening to a developing chamber of a developing device.

BRIEF DESCRIPTION OF THE DRAWINGS

FIGS. 6A to 6C are diagrams illustrating an operation of the agitator, in which FIG. 6A is a top view showing a state where the developer is accumulated toward a supply opening side by an oblique agitation blade, FIG. 6B is a top view showing a state where the developer is delivered toward a supply opening side, and FIG. 6C is a front view showing a state where movement of the developer is regulated by a backflow prevention wall;

FIGS. 7A and 7B are perspective views of the agitator using a supply wall that does not have an opening, in which FIG. 7A shows a state as viewed from the oblique agitation blade side, and FIG. 7B shows a state as viewed from a backflow prevention wall side;

FIGS. 8A and 8B are perspective views of the agitator in which a rectangular flexible sheet is used as the delivery agitation blade, in which FIG. 8A shows a state as viewed from the oblique agitation blade side, and FIG. 8B shows a state as viewed from the backflow prevention wall side;

FIGS. 10A and 10B are perspective views of the agitator in which a delivery agitation blade is integrally formed with a support wall, in which FIG. 10A is a perspective view showing a state as viewed from the oblique agitation blade side, and FIG. 10B is a perspective view showing a state as viewed from the backflow prevention wall side;

FIGS. 11A and 11B are perspective views of the agitator in which openings are not formed at the center of the support wall, in which FIG. 11A is a perspective view showing a state as viewed from the oblique agitation blade side, and FIG. 11B is a perspective view showing a state as viewed from the backflow prevention wall side;

FIGS. 12A to 12C are diagrams showing an operation of the agitator shown in FIGS. 11A and 11B, in which FIG. 12A is a top view showing a state where the developer is accumulated toward a supply opening side by the oblique agitation blade, FIG. 12B is a top view showing the state wherein developer is delivered through the supply opening, and FIG. 12C is a front view showing the state wherein moving object of the developer is regulated by a backflow prevention wall;

FIGS. 13A and 13B are diagrams showing the agitator in which opening portions are formed in a proximal end portion of an oblique agitation blade, in which FIG. 13A is a perspective view showing a state as viewed from the oblique agitation blade side, and FIG. 13B is a front view as viewed from a delivery agitation blade side; and FIGS. 14A to 14C are plan views showing a modified example of the delivery agitation blade, in which FIG. 14A is a plan view showing a state in which both end portions of a slit are not bilaterally symmetric, FIG. 14B is a plan view showing a state in which the distal end portion is divided into three parts by two slits, and FIG. 14C is a plan view showing a state in which a slit extends from the distal end to the proximal end and a delivery agitation blade is divided into four parts.

DETAILED DESCRIPTION

<General Overview>

Figure 1:
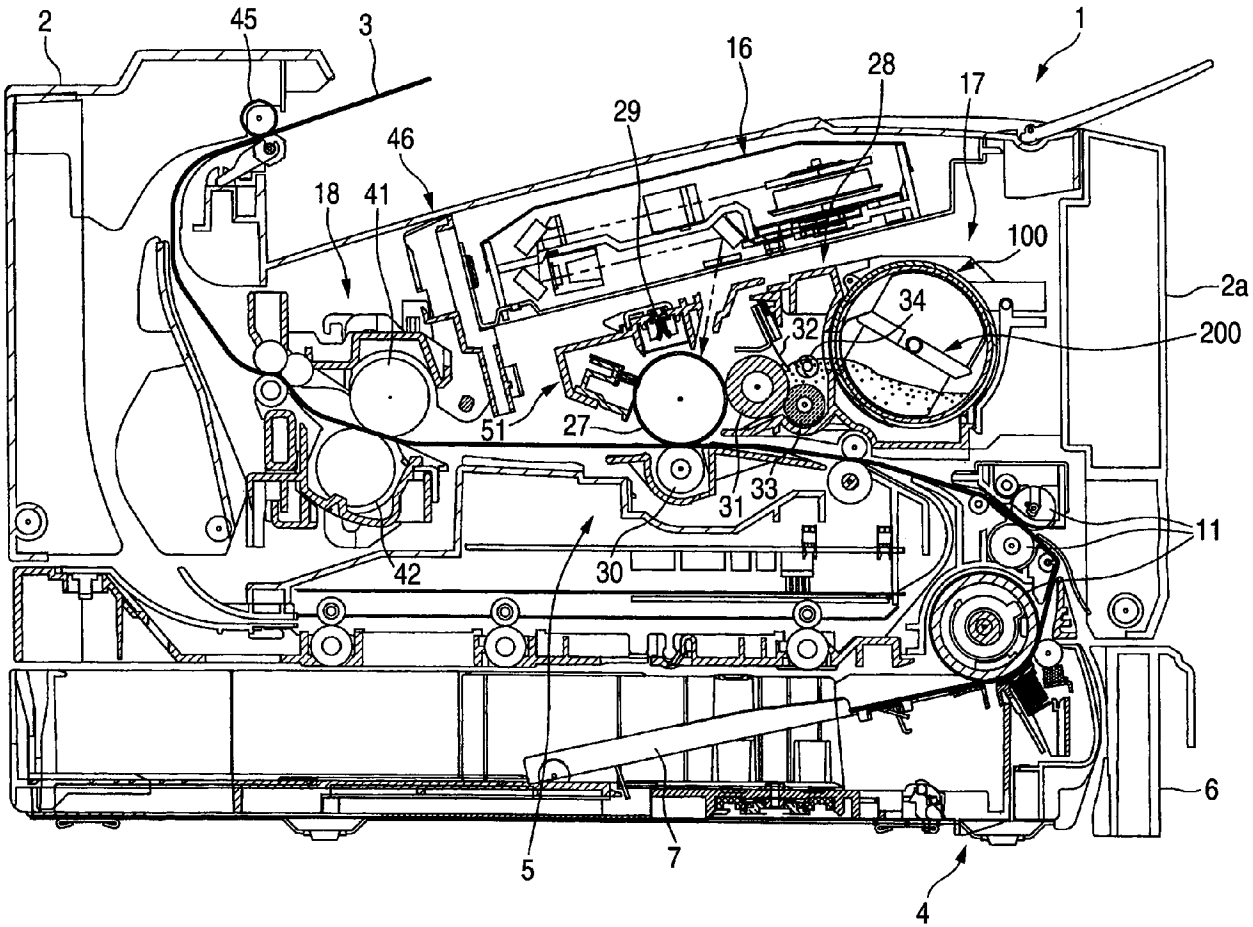
FIG. 1 is a side sectional view of an image forming apparatus according to the invention.

According to an aspect of the present invention, there is provided a developer cartridge comprising: a housing that is attachable to and detachable from a developing device and is configured to accommodate developer; and an agitator that is configured to agitate the developer accommodated in the housing and supply the developer to the developing device through a supply opening formed in the housing, wherein the agitator comprises: a rotation shaft that is rotatably supported by the housing; a support plate that extends from the rotation shaft to one side in a diameter direction of the rotation shaft; a delivery agitation blade that is supported by the support plate and is configured to pass through a position opposing the supply opening along an inner surface of the housing by rotation of the rotation shaft, the delivery agitation blade comprising a first end portion, and an entire width of the first end portion being supported by a distal end portion of the support plate; and an oblique agitation blade that is erected from a surface of the support plate and is oblique to the rotation shaft in order to move the developer in an axial direction of the rotation shaft toward the supply opening.

<Exemplary Embodiments>

Exemplary embodiments of the invention will be described with reference to the drawings.

In the related art, since the blades of the agitator have a known flexible sheet structure having a rectangular shape, for example, a further improvement is required in order to ensure smooth circulation of developer. Specifically, in the related art, since the blades of the agitator are rectangular flexible sheet and a distal end thereof makes sliding contact with an inner surface of a developer cartridge, only the developer in the vicinity of the supply opening is scooped by the flexible sheet and is supplied through the supply opening toward the developing chamber. Thus, when the amount of the developer in the vicinity of the supply opening is small, the developer may not be supplied sufficiently to the developing chamber through the supply opening.

Herein, in order to smoothly and efficiently circulate the developer between the developer cartridge and the developing chamber, a sufficient amount of developer should be supplied through the supply opening. When a sufficient amount of developer is supplied through the supply opening, the developer in the developing chamber of which the amount became a predetermined amount or more is returned through the return opening to the developer cartridge, and the returned developer is accumulated again toward the supply opening and supplied again through the supply opening to the developing chamber. Accordingly, the developer can be smoothly and efficiently circulated.

Moreover, even when the return opening is not formed in the developer cartridge and only the supply opening is formed in the developer cartridge, the above-described agitator may not be able to supply a sufficient amount of developer through the supply opening.

Aspects of the present invention provide a developer cartridge capable of supplying a sufficient amount of developer through a supply opening to a developing chamber of a developing device.

(1) Image Forming Apparatus

As shown in FIG. 1, an image forming apparatus 1 includes a main casing 2, a feeder unit 4 for conveying sheet 3, an image forming unit 5 for forming images on the sheet 3, and the like.

(2) Feeder Unit

The feeder unit 4 includes a sheet feed tray 6, a sheet pressing plate 7 and various rollers 11. In the feeder unit 4, the sheet 3 in the sheet feed tray 6 is moved upward by the sheet pressing plate 7 and conveyed to an image forming unit 5 by the various rollers 11.

(3) Image Forming Unit

The image forming unit 5 includes a scanner unit 16 as an example of an exposure unit, a process cartridge 17, a fixing unit 18, and the like.

(4) Scanner Unit

The scanner unit 16 includes a laser emitting part (not shown), a polygon mirror, lenses and a reflection mirror (not denoted by reference numeral). In the scanner unit 16, a laser beam travels along a path indicated by a chain line in the drawing and is scanned and irradiated onto the surface of a photosensitive drum 27 in the process cartridge 17.

(5) Process Cartridge

The process cartridge 17 is detachably attached to the main casing 2 by opening a front cover 2*a*. The process cartridge 17 includes a developing cartridge 28 as an example of a developing device and a drum unit 51, etc.

The developing cartridge 28 is configured to be detachable from the main casing 2 in a state where it is attached to the drum unit 51. The developing cartridge 28 may be configured to be detachable from the drum unit 51 that is fixed to the main casing 2.

The developing cartridge 28 includes a developing roller 31, a thickness regulation blade 32, a supply roller 33 and an auger 34. A developer cartridge 100 (which will be described later) is detachably attached to the developing cartridge 28. The developer in the developer cartridge 100 is agitated by an agitator 200 and is supplied to the developing roller 31 by the supply roller 33. At this time, the developer is positively charged by friction while being rubbed between the supply roller 33 and developing roller 31. Subsequently, with the rotation of the developing roller 31, the developer supplied onto the developing roller 31 is moved between the thickness regulation blade 32 and the developing roller 31, where the developer is then carried as a thin layer of a predetermined thickness on the developing roller 31.

The drum unit 51 includes a photosensitive drum 27, a scorotron charger 29 and a transfer roller 30. In the drum unit 51, the surface of the photosensitive drum 27 is uniformly charged with positive charges by the scorotron charger 29 and is thereafter exposed by the laser beam fast-scanned from the scanner unit 16. With this exposure, the electric potential at the exposed portion decreases and thus electrostatic latent images based on image data are formed on the exposed portion. Here, the term, "electrostatic latent images," refers to an exposed portion which is exposed by the laser beam and the electric potential of which is decreased, among portions on the surface of the photosensitive drum 27 which is uniformly charged with positive charges. Next, when the developer carried on the surface of the developing roller 31 is brought into opposing contact with the photosensitive drum 27 by the rotation of the developing roller 31, the developer carried on the surface of the developing roller 31 is supplied to the electrostatic latent images formed on the surface of the photosensitive drum 27. Then, the developer is selectively carried on the surface of the photosensitive drum 27 and changed to a visible image, whereby a developer image is formed by reversal development.

Thereafter, the photosensitive drum 27 and a transfer roller 30 are rotated to convey the sheet 3 pinched between them, and when the sheet 3 is conveyed while being pinched between the photosensitive drum 27 and the transfer roller 30, the developer image carried on the surface of the photosensitive drum 27 is transferred onto the sheet 3.

(6) Fixing Unit

The fixing unit 18 includes a heating roller 41 and a pressure roller 42. In the fixing unit 18, the developer transferred onto the sheet 3 is thermally fixed during the passage of the sheet 3 between the heating roller 41 and the pressure roller 42. Moreover, the sheet 3 thermally fixed in the fixing unit 18 is delivered to a sheet discharge tray 46 by a sheet discharge roller 45 disposed on the downstream side of the fixing unit 18.

(7) Developer Cartridge

Figure 2:
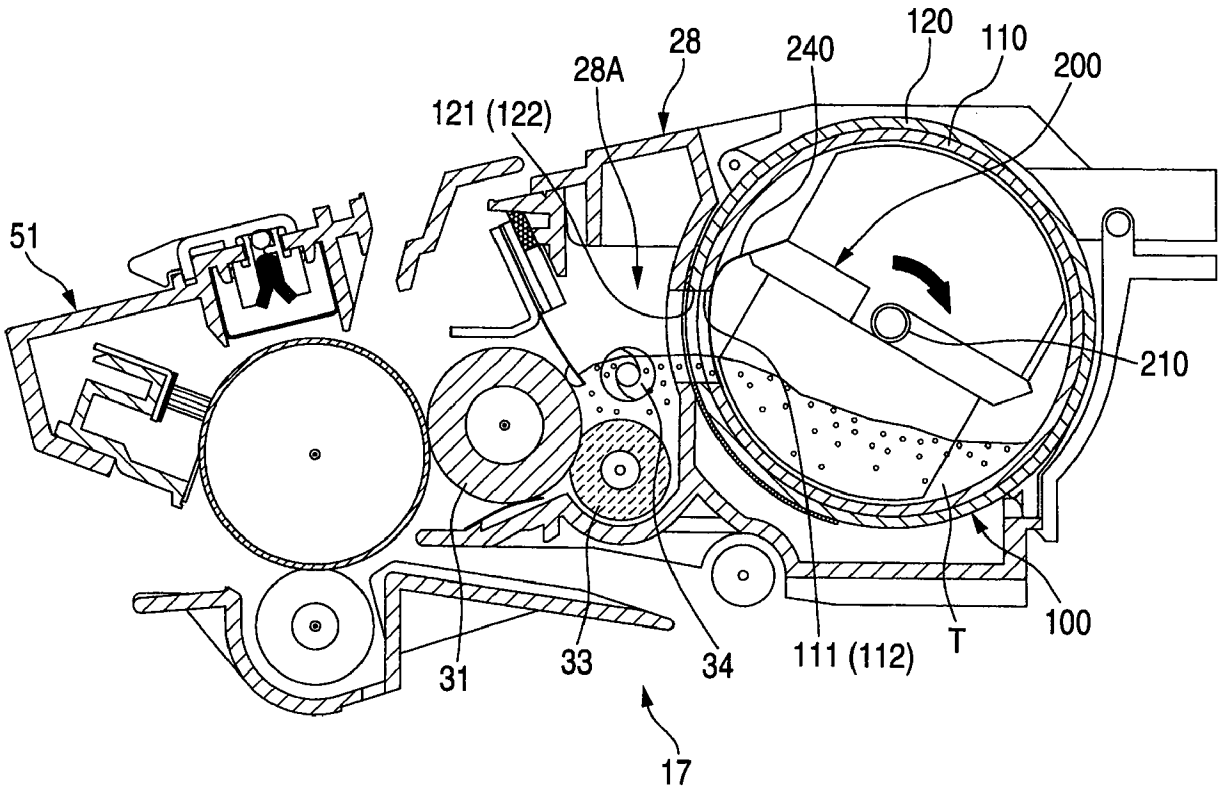
FIG. 2 is an enlarged sectional view illustrating a detailed structure of a developer cartridge.
Figure 3A:
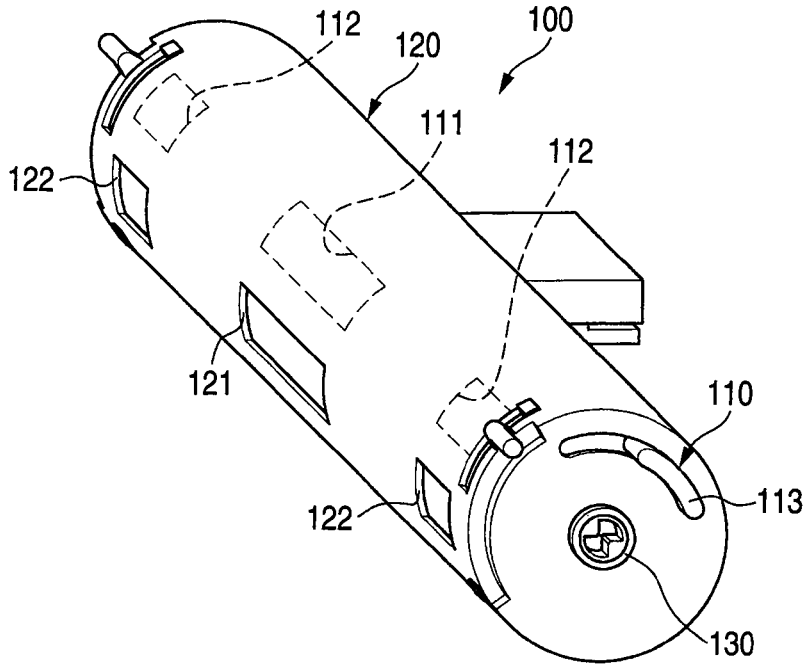
FIG. 3A is a perspective view of the developer cartridge in a closed state.
Figure 3B:
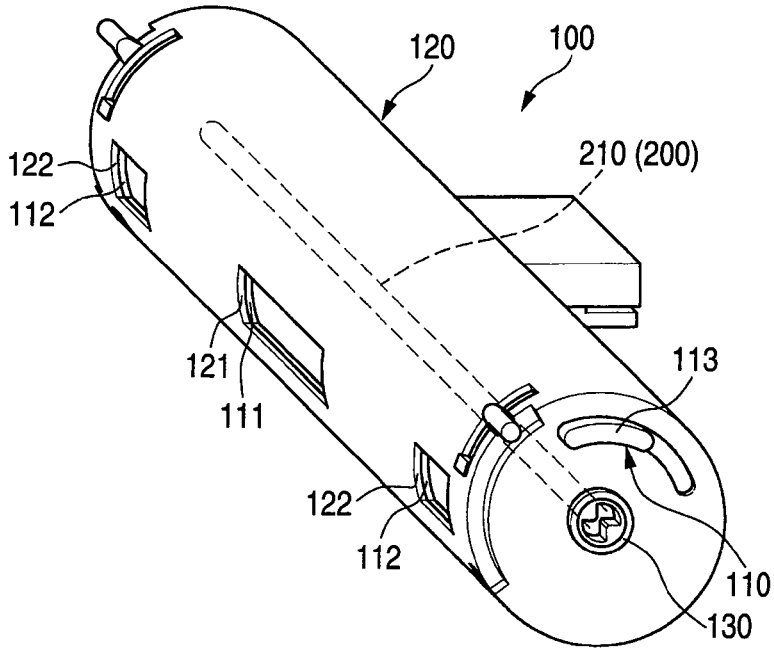
FIG. 3B is a perspective view of the developer cartridge in an open state.
Figure 4A:
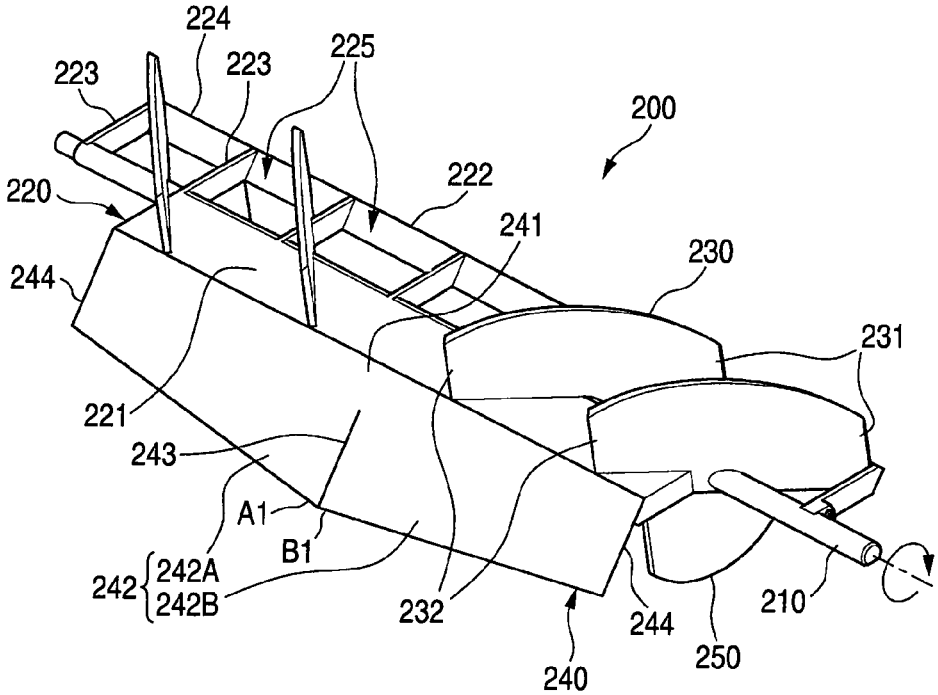
FIG. 4A is a perspective view of an agitator showing a state as viewed from an oblique agitation blade side.
Figure 4B:
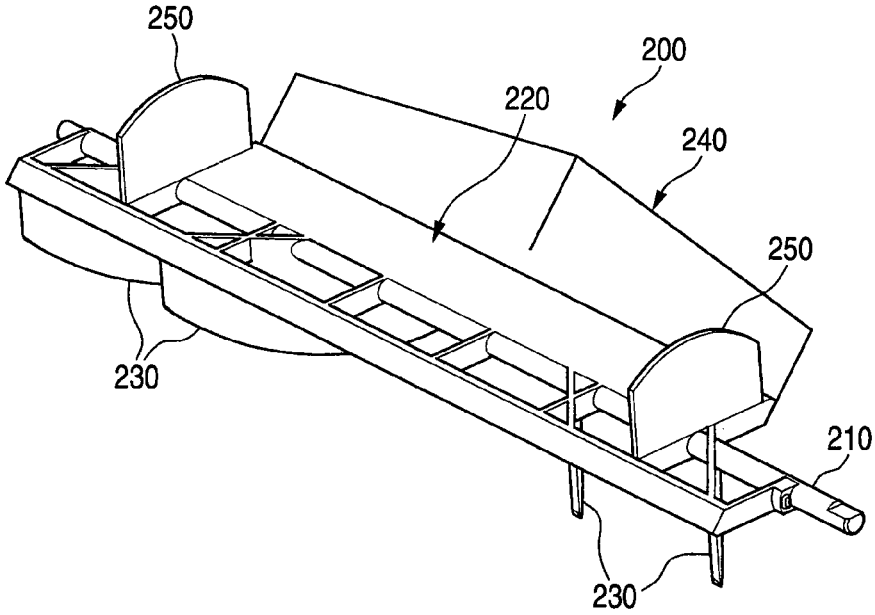
FIG. 4B is a perspective view of the agitator showing a state as viewed from a side opposite to the oblique agitation blade side.
Figure 5A:
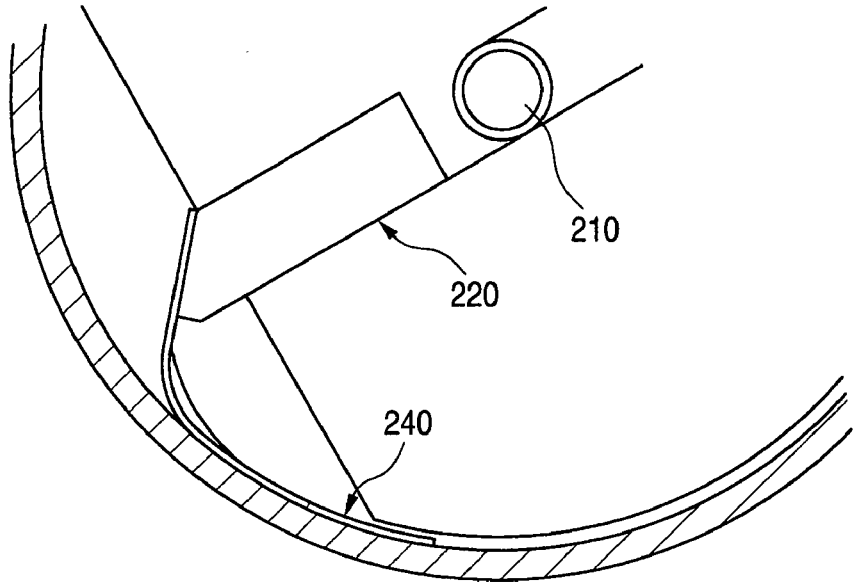
FIG. 5A is an enlarged sectional view of a delivery agitation blade showing a state where the delivery agitation blade is in sliding contact with an inner circumferential surface of an inside housing.
Figure 5B:
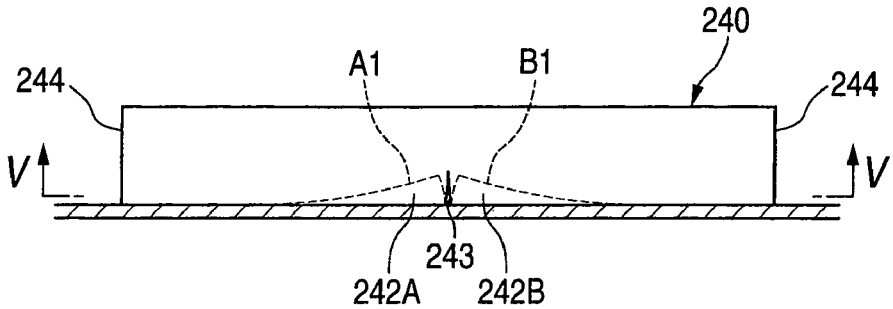
FIG. 5B is a top view of the delivery agitation blade showing a state as viewed from the above.
Figure 5C:
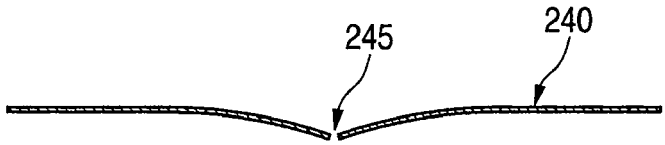
FIG. 5C is a sectional view taken along the line V-V in FIG. 5B.

Next, the detailed structure of the developer cartridge 100 as an example of a developer cartridge according to the present invention will be described. In the drawings, FIG. 2 is an enlarged sectional view illustrating a detailed structure of a developer cartridge. FIG. 3A is a perspective view of the developer cartridge in a closed state, and FIG. 3B is a perspective view of the developer cartridge in an open state. FIG. 4A is a perspective view of an agitator showing the state as viewed from an oblique agitation blade side, and FIG. 4B is a perspective view of the agitator showing the state as viewed from a side opposite to the oblique agitation blade side. FIG. 5A is an enlarged sectional view of a delivery agitation blade showing the state where it is in sliding contact with an inner circumferential surface of an inside housing, FIG. 5B is a top view of the delivery agitation blade showing the state as viewed from the above, and FIG. 5C is a sectional view taken along the line V-V in FIG. 5B.

As shown in FIG. 2, the developer cartridge 100 constitutes the process cartridge 17 together with the developing cartridge 28 and the drum unit 51 described above, and the developer cartridge 100 is detachably attached to the developing cartridge 28. Specifically, the developer cartridge 100 includes an inside housing 110 configured to accommodate developer T therein, an outside housing 120 configured to be displaced relative to the inside housing 110 and the agitator 200.

The inside housing 110 has a hollow, cylindrical shape, and is rotatably supported by a substantially cylindrical, inner circumferential surface of the outside housing 120. Moreover, a supply opening 111 for supplying the developer T to the inside of the developing cartridge 28 is formed in a portion at the side of the developing cartridge 28 of an outer circumferential wall (a wall opposite a rotation shaft 210 of the agitator 200 in the diameter direction) of the cylindrical shape of the inside housing 110. Moreover, as shown in FIG. 3B, the supply opening 111 is formed at a center portion in the axial direction of the inside housing 110. Furthermore, return openings 112 for returning the developer T from a developing chamber 28A (see FIG. 2) in the developing cartridge 28 to the inside of the developer cartridge 100 are formed at both the left and right sides (opposite positions in the axial direction of the inside housing 110) of the return opening 111 as shown in FIG. 3B.

The outside housing 120 has a substantially hollow, cylindrical shape, and at corresponding portions at the side of the developing cartridge 28 of an outer circumferential wall of the cylindrical shape of the outside housing 120, a supply opening 121 communicating with the supply opening 111 of the inside housing 110 and return openings 122 communicating with the return openings 112 of the inside housing 110. That is, the supply opening 121 and the return openings 122 of the outside housing 120 are formed at positions corresponding to the supply opening 111 and the return openings 112 of the inside housing 110, the three openings being arranged in the axial direction.

A gear part 130 is disposed on an end surface at one end side of the outside housing 120, the gear part 130 being fixed at an end portion of a rotation shaft 210 of the agitator 200 that is rotatably provided to the inside housing 110 and the outside housing 120. When driving force is transmitted from the side of the main casing 2 to the gear part 130, the agitator 200 is rotated.

The inside housing 110 and the outside housing 120 having the above-described construction are configured such that when developer cartridge 100 is attached to the developing cartridge 28, the outside housing 120 is fixed to the developing cartridge 28 and the inside housing 110 is rotated relative to the outside housing 120. The rotation structure is well known: to briefly describe, a projection 113 having a circular arc shape formed at an end portion of the inside housing 110 shown in FIG. 3A engages with a lever (not shown) and is moved along the circular arc shape by a lever operation, whereby the inside housing 110 is rotated relative to the outside housing 120. Moreover, in a state shown in FIG. 3A where the developer cartridge 100 is not attached thereto, the supply opening 111 and the return openings 112 of the inside housing 110 are closed by the circumferential wall of the outside housing 120. Meanwhile, in a state shown in FIG. 3B where the developer cartridge 100 is attached and the inside housing 110 is rotated, the supply opening 111 and the return openings 112 of the inside housing 110 are communicated with the supply opening 121 and the return openings 122 of the outside housing 120 so that the developer T can be supplied through the openings←openings??.

As shown in FIGS. 4A and 4B, the agitator 200 includes the rotation shaft 210, a support wall 220, oblique agitation blades 230, a delivery agitation blade 240 and backflow prevention walls 250.

As shown in FIG. 3B, the rotation shaft 210 is rotatably supported by the inside housing 110 and the outside housing 120 and is configured to pass across the inside of the inside housing 110 (specifically, the rotation shaft 210 is coaxial to the center axis of the inside housing 110).

The support wall 220 includes a support plate portion 221 that is integrally formed with the rotation shaft 210 and extends from the rotation shaft 210 toward one end side in the diameter direction thereof and a support frame portion 222 that extends in a direction opposite to the extending direction of the support plate portion 221. The support plate portion 221 is shorter than the support frame portion 222 in the axial direction of the rotation shaft 210. As a result, a portion of the support wall 220 opposite the return openings 112 (see FIG. 3) of the inside housing 110 has a notch shape. The support frame portion 222 includes a plurality of first arm portions 223 that extends in the diameter direction from the rotation shaft 210 and a second arm portion 224 that extends in the axial direction of the rotation shaft 210. Moreover, a plurality of openings 225 is formed by the first arm portions 223, the second arm portion 224 and the rotation shaft 210.

The oblique agitation blade 230 has a distal end thereof formed along the inner peripheral surface of the inside housing 110, and is erected from a surface of the support wall 220 so as to be oblique to the rotation shaft 210 over portions of the support wall 220 from the distal end of the support plate portion 221 to the distal end of the support frame portion 222. Specifically, two pairs of oblique agitation blades 230 (four in total) are provided on the support wall 220 with the supply opening 111 disposed between them so that a backward-side end portion 232 in the rotation direction of the rotation shaft 210 is positioned closer to the supply opening 111 (see FIG. 3) of the inside housing 110 than an forward-side end portion 231 in the rotation direction of the rotation shaft 210. More specifically, the forward-side end portion 231 of the oblique agitation blade 230 in the rotation direction is integrally formed on the support frame portion 222, and the backward-side end portion 232 in the rotation direction is integrally formed on the support plate portion 221.

The delivery agitation blade 240 is formed of flexible sheet that is elongated in the axial direction of the rotation shaft 210 and is supported by the rotation shaft 210 via the support plate portion 221 of the support wall 220. Specifically, the delivery agitation blade 240 has a proximal end portion 241 of which the entire width (the length in the axial direction of the rotation shaft 210) is fixed to the distal end of the support plate portion 221, whereby a distal end portion 242 thereof can make sliding contact with the inner circumferential surface of the inside housing 110 in a bent state (see FIG. 5). The distal end portion 242 is divided into two parts by one slit 243, and the divided distal end portions 242A and 242B have a mound shape that is inclined toward the proximal end portion 241 as they extend from the slit 243 toward outermost ends 244. With such a structure, the bending force of the distal end portions 242A and 242B becomes the greatest at a portion close to the slit 243 and the smallest at portions close to the outermost ends 244. For this reason, as shown in FIG. 5B, when the distal end portions 242A and 242B make sliding contact with the inner circumferential surface of the inside housing 110, ends Al and B1 of the distal end portions 242A and 242B experience different delay amounts in the rotation direction. As a result, as shown in FIG. 5C, a concave portion 245 that is concave to the backward side in the rotation direction is formed in the delivery agitation blade 240. Here, a small gap is formed at the center portion of the concave portion 245 which is formed by bending the distal end portion 242 having the slit 243. However, the inclination angle of the ends Al and B1 of the distal end portions 242A and 242B or the free length of the delivery agitation blade 240 is appropriately set such that the amount of developer T collected in the concave portion 245 is much greater than the amount of developer T flowing out through the gap. Therefore, the developer T can be efficiently conveyed in the concave portion 245. In addition, the slit 243 is formed at a position opposite the supply opening 111 of the inside housing 110. Therefore, the concave portion 245 can pass through the position opposite the supply opening 111 of the inside housing 110 by the rotation of the rotation shaft 210.

Figure 6A:
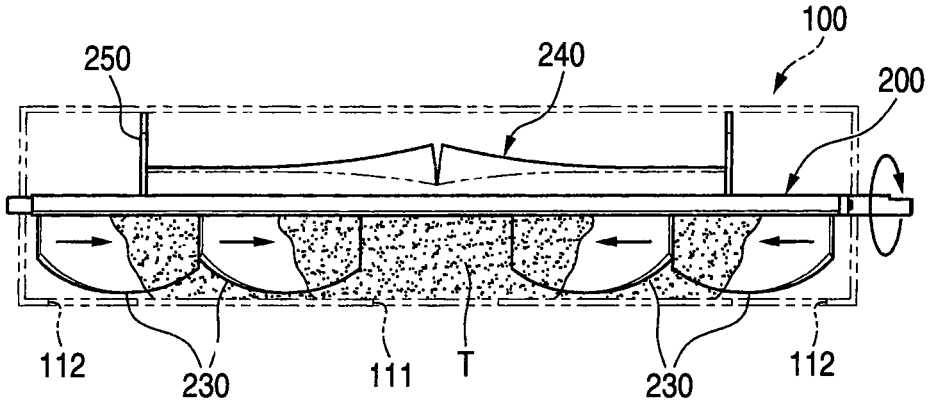
Figure 6B:
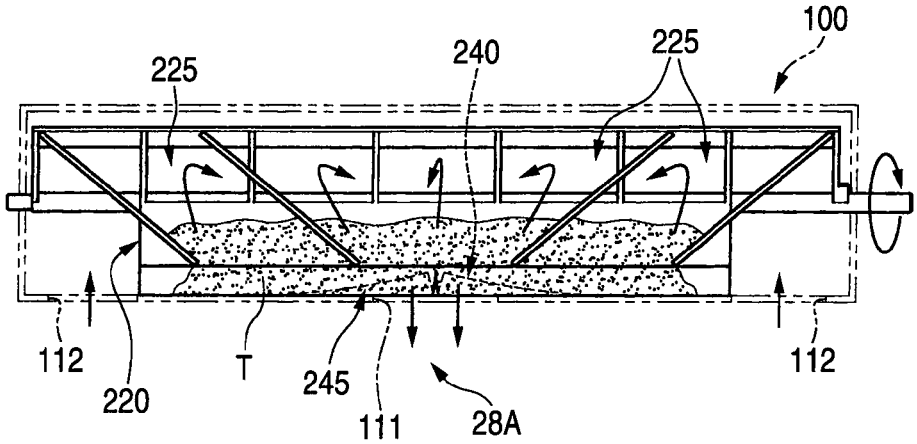
Figure 6C:
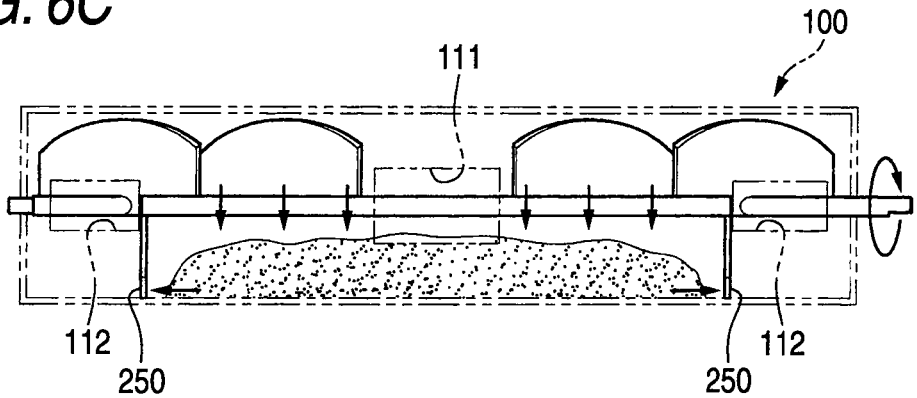

As shown in FIG. 4B, the backflow prevention wall 250 has a distal end thereof formed along the inner circumferential surface of the inside housing 110 and is paired with another backflow prevention wall so that they are perpendicular to the rotation shaft 210 on a surface of the support wall 220 at an opposite side of the oblique agitation blades 230. Specifically, the backflow prevention walls 250 are disposed along ends of the return openings 112 at the side of the supply opening 111 between the return openings 112 the supply opening 111 of the inside housing 110, as shown in FIG. 6C.

Next, the operation of the agitator 200 according to the present embodiment will be described. In the drawings, FIGS. 6A to 6C are diagrams illustrating an operation of the agitator, in which FIG. 6A is a top view showing the state wherein developer is accumulated toward a supply opening side by the oblique agitation blade, FIG. 6B is a top view showing the state wherein the developer is delivered through the supply opening, and FIG. 6C is a front view showing the state wherein movement of the developer is regulated by the backflow prevention walls. In FIG. 6C, the delivery agitation blade 240 is not illustrated for the sake of explanation.

As shown in FIG. 6A, when the agitator 200 is rotated, the developer T is accumulated from the sides of the return openings 112 toward the side of the supply opening 111 by a plurality of oblique agitation blades 230, whereby the developer T in the developer cartridge 100 is conveyed from the sides of the return openings 112 to the side of the supply opening 111. Then, as shown in FIG. 6B, the developer T accumulated at the side of the supply opening 111 is accumulated by the concave portion 245 of the delivery agitation blade 240 and delivered through the supply opening 111 to the inside of the developing chamber 28A while the developer T is substantially prevented from flowing out from both ends of the delivery agitation blade 240. Moreover, at this time, since the developer T is conveyed to the return opening 111 by the support plate portion 221, a sufficient amount of developer T is delivered through the return opening 111 to the inside of the developing chamber 28A.

In this manner, when a large amount of developer T is delivered through the supply opening 111 by the concave portion 245, the amount of the developer T in the developing chamber 28A becomes a predetermined amount or more, and the overflowing developer T is returned through the return openings 112 to the inside of the developer cartridge 100. At this time, since the notch portion of the support plate portion 221 is disposed at the position opposite the return openings 112 and since the entire width of the proximal end portion of the delivery agitation blade 240 is supported by the support plate portion 221, the delivery agitation blade 240 is not extended to the notch portion of the support plate portion 221. For this reason, the developer T can be efficiently returned through the return openings 112 to the inside of the developer cartridge 100.

Moreover, when the agitator 200 is rotated, the support plate portion 221 of the support wall 220 is tilted from a parallel state, whereby the developer T carried on the support plate portion 221 is flown toward an opposite side of the supply opening 111. At this time, the developer T between the oblique agitation blade 230 disposed closest to the return openings 112 (i.e., opposing the return openings 112) and the adjacent oblique agitation blade 230 (hereinafter, referred to as second oblique agitation blade 230), which is to be returned toward the return openings 112 by the second oblique agitation blade 230, falls on a lower half portion of the developer cartridge 100 through the openings 225 formed between the two oblique agitation blades 230. Moreover, movement of the fallen developer T toward the side of the return openings 112 is regulated by the backflow prevention walls 250 as shown in FIG. 6C.

According to the configuration described above, the present embodiment can provide the following advantages.

Since the developer T accumulated toward the supply opening 111 by the plurality of oblique agitation blades 230 is efficiently conveyed to the supply opening 111 by the support plate portion 221 and the delivery agitation blade 240, a sufficient amount of developer T can be supplied through the supply opening 111 to the developing chamber 28A.

Since a lot of developer T can be efficiently delivered by the concave portion 245 of the delivery agitation blade 240 through the supply opening 111 to the developing chamber 28A, it is possible to ensure smoother circulation of the developer T.

Since the concave portion 245 is formed by bending the flexible sheet having formed therein the slit 243, it is possible to simplify the structure and to thus reduce the cost.

Since the portion of the support wall 220 opposite the return openings 112 is notched, it is possible to efficiently return the developer T and to thus ensure smoother circulation of the developer T.

Since the openings 225 are formed in portions of the support wall 220 between the oblique agitation blade 230 disposed closest to the return openings 112 and the oblique agitation blade 230 adjacent to this oblique agitation blade 230, the developer T can fall through the openings 225 before it is returned to the side of the return openings 112 even when the developer T is to be accumulated toward the side of the return openings 112 by the oblique agitation blades 230. For this reason, the developer T is accumulated in the vicinity of the return openings 112. Therefore, it is possible to ensure smoother circulation of the developer T without causing a problem that the developer T is hardly returned from the developing chamber 28A to the inside of the developer cartridge 100.

Since the backflow prevention walls 250 are provided between the return openings 112 and the supply opening 111, it is possible to prevent a back flow of the developer T from the side of the supply opening 111 toward the side of the return openings 112. Moreover, since the backflow prevention walls 250 are disposed along the ends of the return openings 112 close to the supply opening 111, even when the developer T falls through the openings 225 between the oblique agitation blade 230 disposed closest to the return openings 112 and the adjacent oblique agitation blade 230, the backflow prevention walls 250 can prevent the back flow of the developer T.

Since the openings 225 are formed also at both ends of the support frame portion 222, specifically, at portions opposite the return openings 112, it is possible to suppress the developer T from being forced back through the return openings 112 toward the developing chamber 28A at both ends of the support frame portion 222, thereby ensuring the smoother circulation of the developer T. Since the delivery agitation blade 240 making sliding contact with the inner circumferential surface of the inside housing 110 is not provided at both ends of the support frame portion 222, the flow of the developer T returned through the return openings 112 to the inside of the inside housing 110 is not interfered by such a blade, whereby the smoother circulation of the developer T can be ensured.

MODIFIED EXAMPLES

Although the present invention has been described based on the above-described exemplary embodiments, the present invention is not limited to the above-described exemplary embodiments. It will be understood that the present inventive concept may be subjected to various improvements and modifications within the scope of the present invention.

For example, in the above-described exemplary embodiments, although the present inventive concept has been described in relation to a laser printer, the present inventive concept is not limited to any specific type of laser printer. Rather, the present inventive concept can be applied to other image forming apparatuses such as a copying machine or a multi-functional device.

Further, in the above-described exemplary embodiments, although the scanner unit 16 is employed as the exposure means, the present invention is not limited to this. For example, an LED head may be used. Incidentally, the structure of the conveying means or the fixing means may be appropriately modified.

Still further, in the above-described exemplary embodiments, although the single supply opening 111 (121) and two return openings 112 (122) are provided, the number of openings may be arbitrary. For example, one supply opening may be provided at one end side of the developer cartridge, and one return opening may be provided at the other end side of the developer cartridge.

Figure 7A:
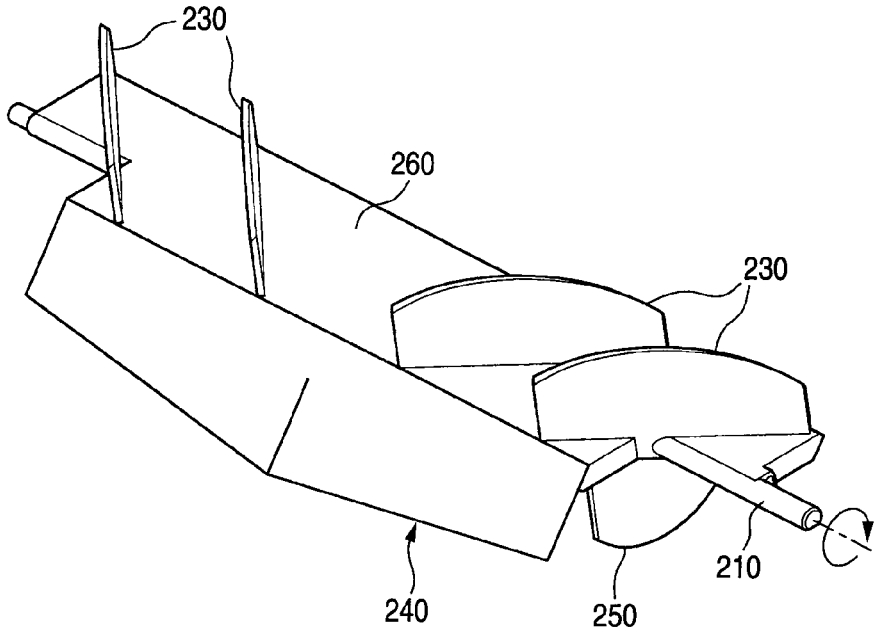
Figure 7B:
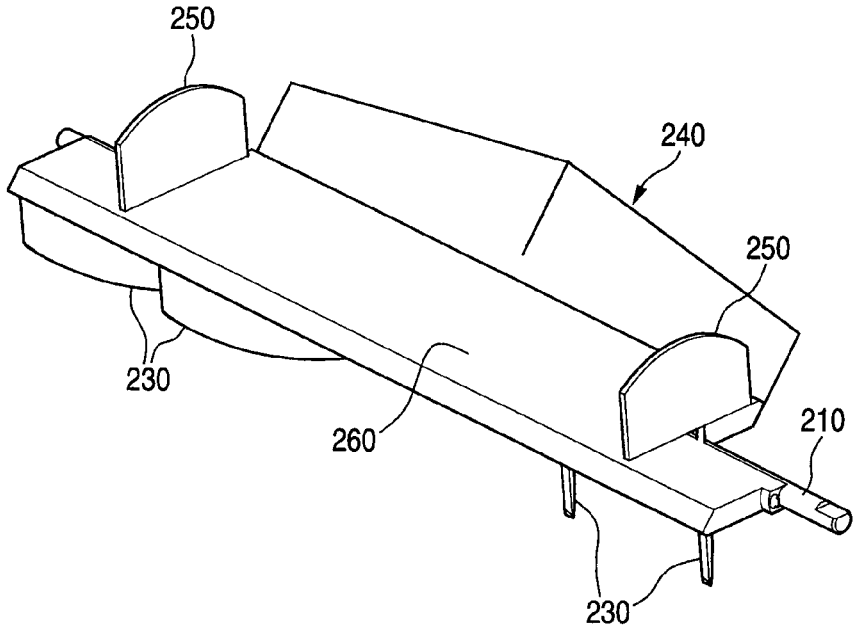

Still further, in the above-described exemplary embodiments, the support wall 220 is formed by the support plate portion 221 and the support frame portion 222 and a plurality of openings 225 is formed in the support wall 220. Alternatively, as shown in FIGS. 7A and 7B, a planar support wall 260 having no openings formed therein may be used, for example. Moreover, the support wall may be formed by only the support plate portion 221 according to the present embodiment.

Figure 8A:
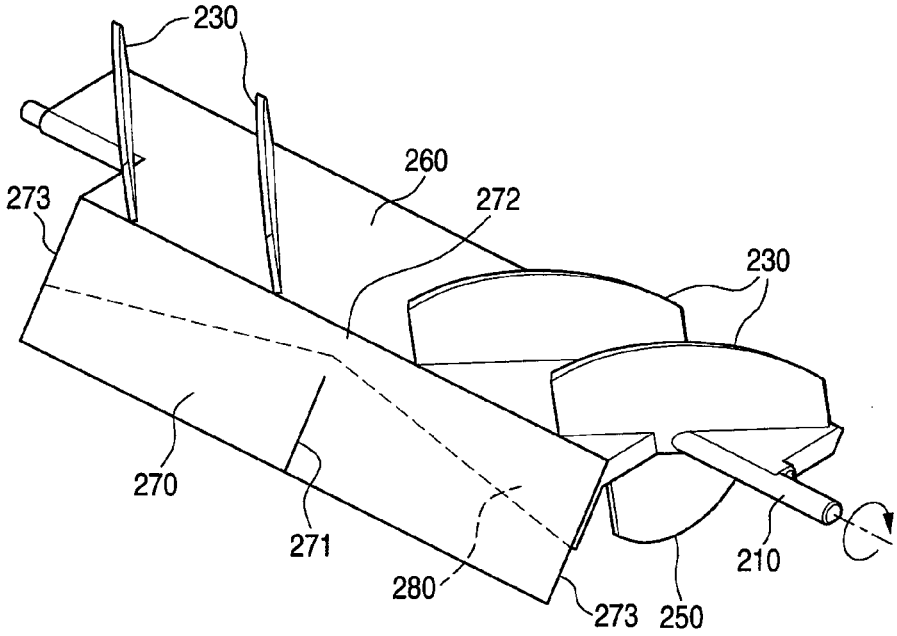
Figure 8B:
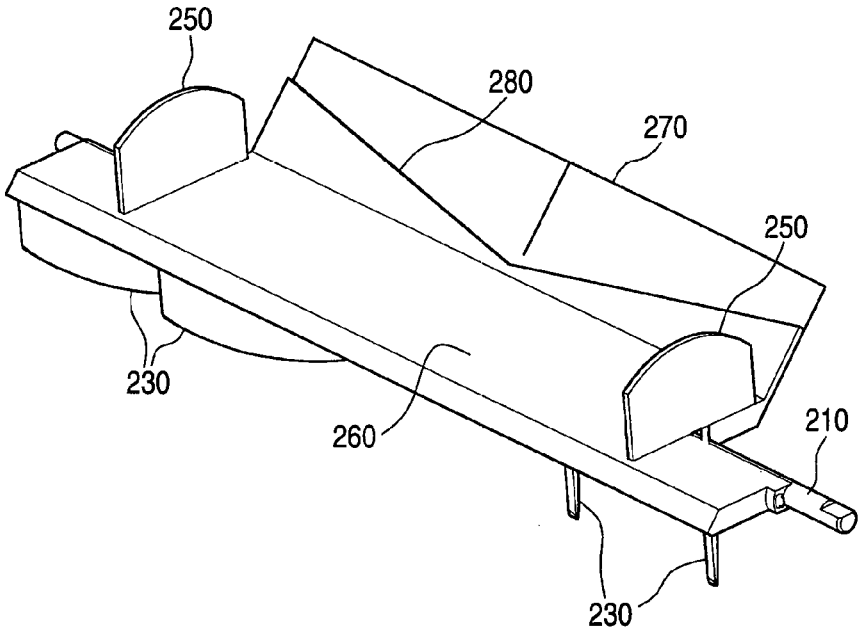
Figure 9A:
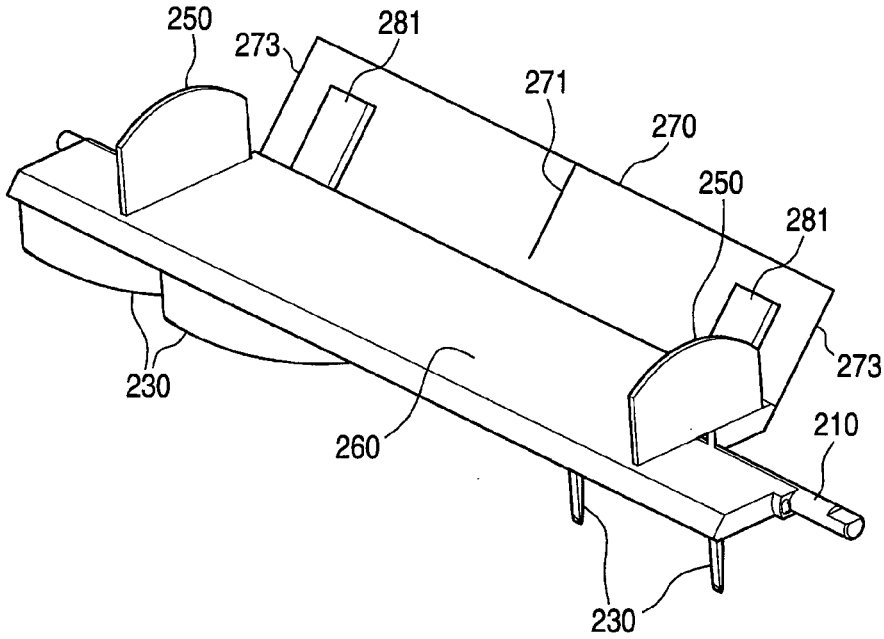
FIG. 9A is a perspective view showing a state in which a bending adjustment wall has a rectangular planar shape.
Figure 9B:
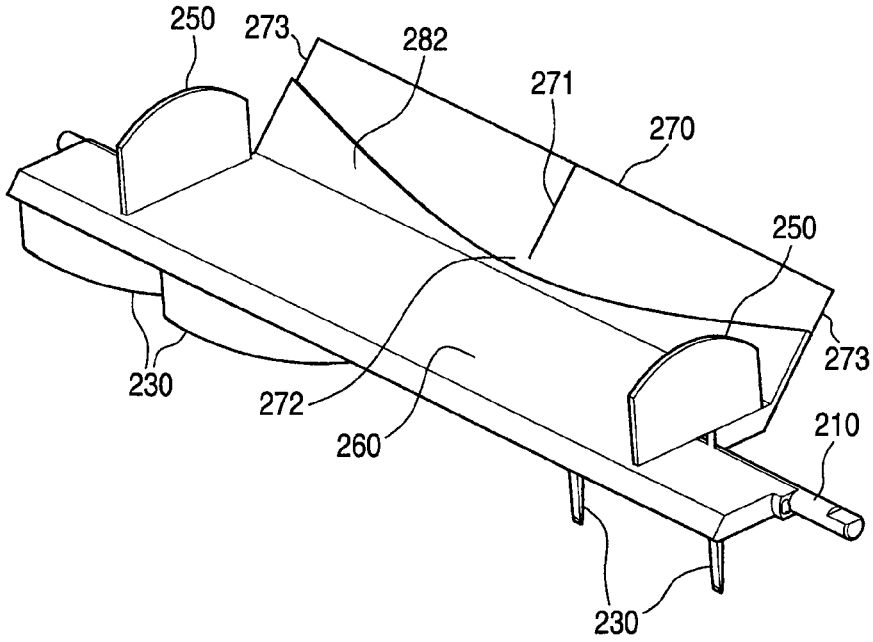
FIG. 9B is a perspective view of a state in which the bending adjustment wall having has an arch-shaped end.

Still further, in the above-described exemplary embodiments, the delivery agitation blade 240 has a mound shape. Alternatively, as shown in FIGS. 8A and 8B, rectangular flexible sheet may be used as the delivery agitation blade 270, for example. In such a case, a slit 271 is formed at a distal end side of the rectangular delivery agitation blade 270, and a proximal end portion 272 of the delivery agitation blade 270 is supported by a bending adjustment wall 280 so that a bending force thereof increases as it goes from the side of the outermost end 273 toward the slit 271. Specifically, as shown in FIG. 8B, the bending adjustment wall 280 is integrally formed with the support wall 260, and the distal end is formed so as to be inclined toward the proximal end portion 272 as it goes from the side of the outermost end 273 of the delivery agitation blade 270 toward the slit 271. Moreover, as shown in FIG. 9A, a pair of rectangular, planar bending adjustment walls 281 may be integrally formed with the support wall 260, and a portion (a portion including the proximal end portion) of the rectangular delivery agitation blade 270 at the side of the outermost end 273 may be supported by the bending adjustment walls 281. Furthermore, as shown in FIG. 9B, the distal end of a bending adjustment wall 282 integrally formed with the support wall 260 may have an arch shape that is concave toward the proximal end portion 272 as it goes from the side of the outermost end 273 of the delivery agitation blade 270 toward the slit 271. As a result of using these bending adjustment walls 280 to 282, similar to the above-described exemplary embodiments, when the delivery agitation blade 270 makes sliding contact with the inner circumferential surface of the inside housing, the end of the distal end portion of the delivery agitation blade 270 supported by either of the bending adjustment walls 280 to 282 undergoes different delay amount in the rotation direction, and a concave portion is formed.

Figure 10A:
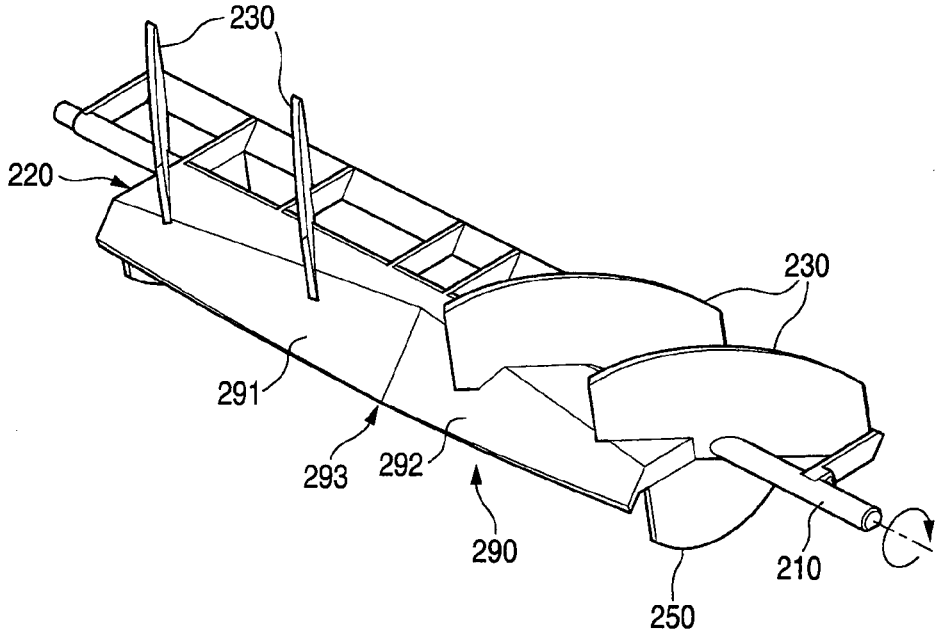
Figure 10B:
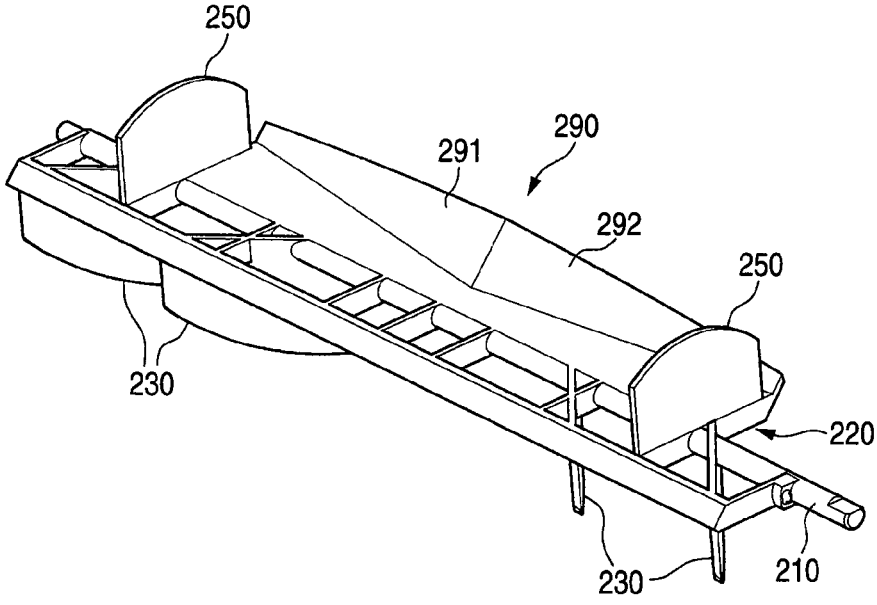
Figure 11A:
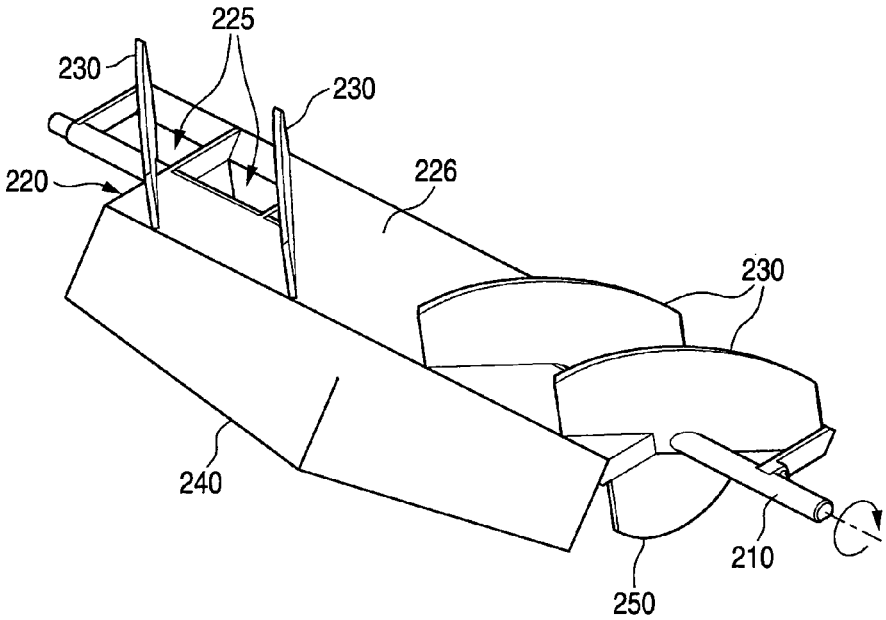
Figure 11B:
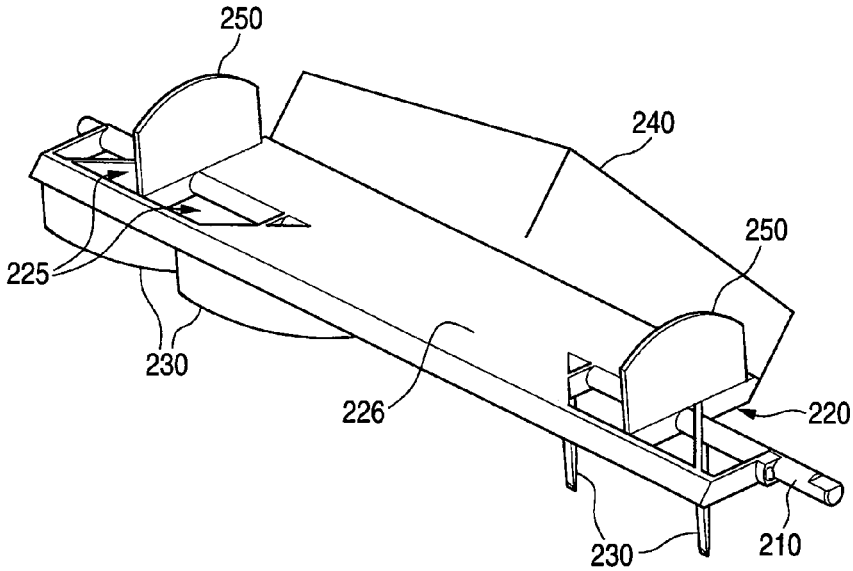

Still further, in the above-described exemplary embodiments, the delivery agitation blade 240 is formed of flexible sheet. Alternatively, the delivery agitation blade 240 may be formed of non-flexible material. For example, as shown in FIGS. 10A and 10B, a delivery agitation blade 290 may be integrally formed with the support wall 220. Specifically, the delivery agitation blade 290 includes a first plate-shaped portion 291 that is inclined toward the backward side in the rotation direction of the rotation shaft 210 as it goes from one end side in the axial direction of the rotation shaft 210 toward the other end side, and a second plate-shaped portion 292 that is integrally formed at the other end side of the first plate-shaped portion 291 and that is inclined toward the backward side in the rotation direction of the rotation shaft 210 as it goes from one end side in the axial direction of the rotation shaft 210 toward the other end side. Moreover, the distal end of the delivery agitation blade 290 is formed along the inner circumferential surface of the inside housing. With this structure, a concave portion 293 is formed by the first plate-shaped portion 291 and the second plate-shaped portion 292. Therefore, it is possible to provide the same advantages as in the above-described exemplary embodiments.

Still further, in the above-described exemplary embodiments, the side of the support plate 220 disposed closer to the delivery agitation blade 240 than the rotation shaft 210 has a planar shape, and the entire opposite side has formed therein a plurality of openings 225. Alternatively, as shown in FIGS.

Figure 12A:
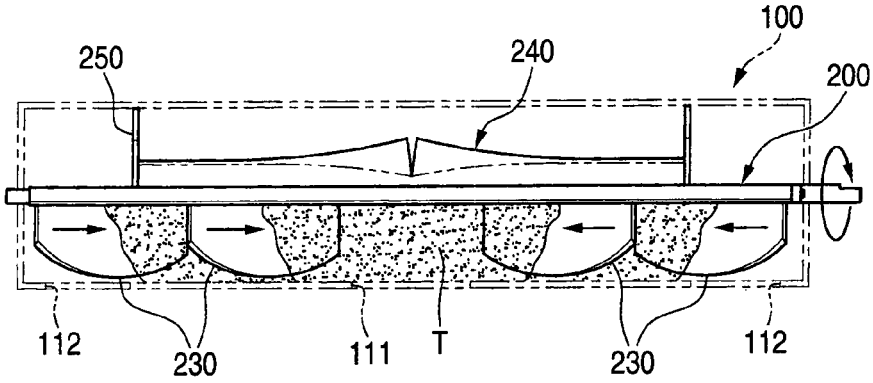
Figure 12B:
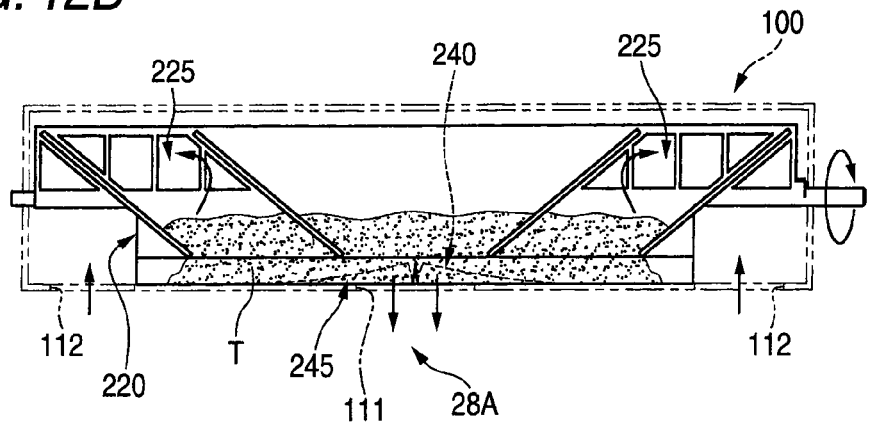
Figure 12C:
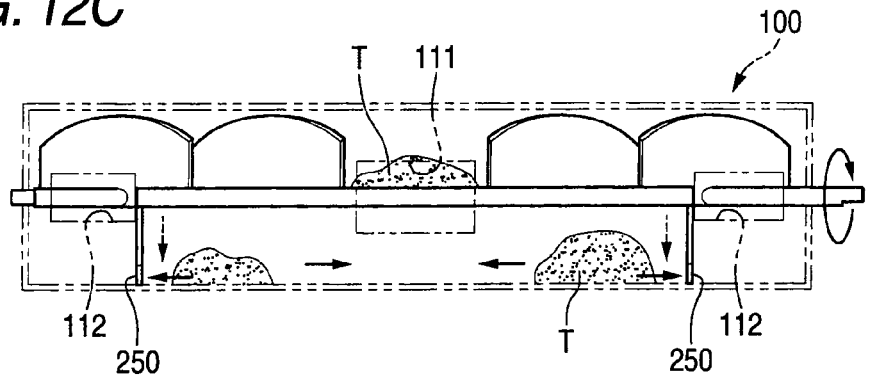

11A and 11B, the openings 225 may not be formed between the inner two oblique agitation blades 230 in the above-described exemplary embodiments, and a plate-shaped portion 226 may be formed instead. Accordingly, as shown in FIGS. 12A and 12B, when the developer T is accumulated toward the side of the supply opening 111 and is then delivered through the supply opening 111 to the developing chamber 28A, the developer T is still carried on the support wall 220 while the developer T disposed at the center of the support wall 220 is prevented from being fallen down. For this reason, as shown in FIG. 12C, the developer T falling through the openings 225 between the oblique agitation blade 230 disposed closest to the return openings 112 and the adjacent oblique agitation blade 230 is restricted to move toward the return openings 112 by the backflow prevention walls 250. Additionally, since the developer T disposed at the center of the support wall 220 is prevented from being fallen down, a space can be created at an under part thereof. Therefore, the developer T can be moved toward the space, and the back flow can be efficiently prevented.

Figure 13A:
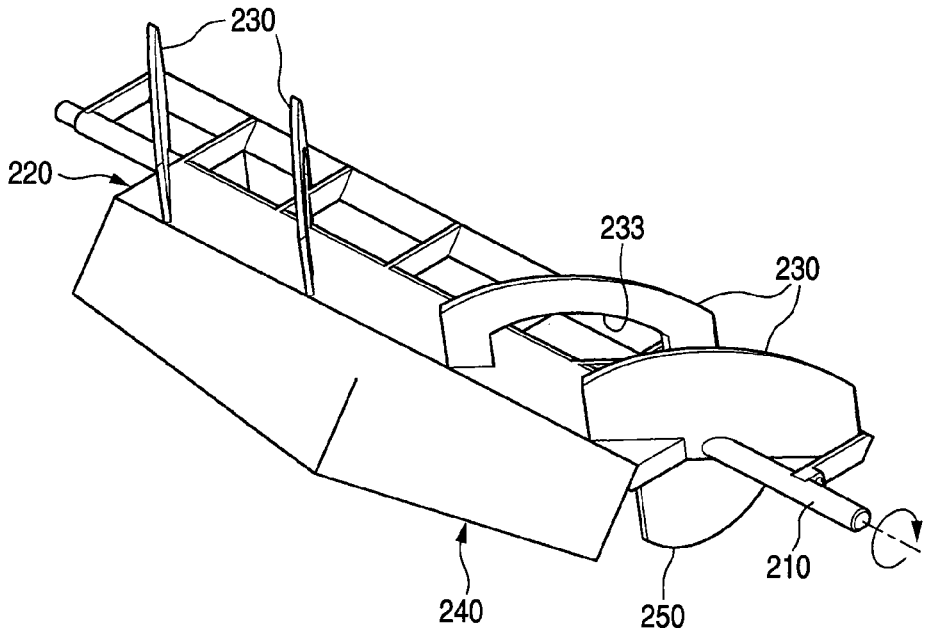
Figure 13B:
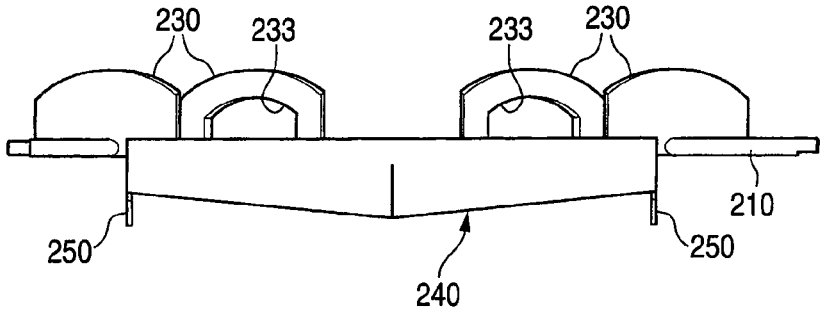

Still further, the shape of the oblique agitation blades 230 is not limited to the above-described exemplary embodiments. For example, as shown in FIGS. 13A and 13B, the end portions (proximal end portions) of the inner two oblique agitation blades 230 close to the rotation shaft 210 may have formed therein opening portions 233. According thereto, when the developer T is accumulated toward the supply opening 111 by the oblique agitation blades 230 as shown in FIG. 6A, the developer T can be efficiently accumulated by the distal end portions of the oblique agitation blades 230 that make sliding contact with the inside housing 110. Alternatively, as shown in FIG. 6B, when the developer T flows toward a side opposite to the supply opening 111, the developer T is passed through the openings 233 of the oblique agitation blades 230, moved along the diameter direction of the rotation shaft 210, and eventually fallen through the openings 225 while the developer T is prevented from being accumulated toward the return openings 112 by the inner two oblique agitation blades 230. For this reason, it is possible to efficiently suppress the back flow of the developer T.

Figure 14A:
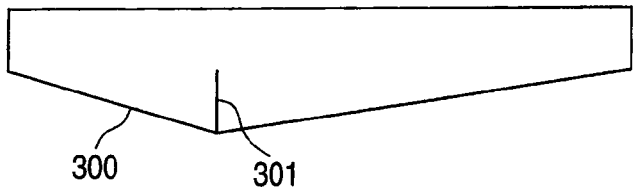

Still further, the shape of the delivery agitation blade 240 is not limited to the above-described exemplary embodiments. The shape of the delivery agitation blade 240 can be arbitrary. For example, the delivery agitation blade 240 may not be bilaterally symmetric as shown in FIG. 14A. In such a case, by forming a slit 301 at the peak point of the mound-shaped delivery agitation blade 300, a concave portion can be formed when the delivery agitation blade makes sliding contact with the inside housing.

Figure 14B:
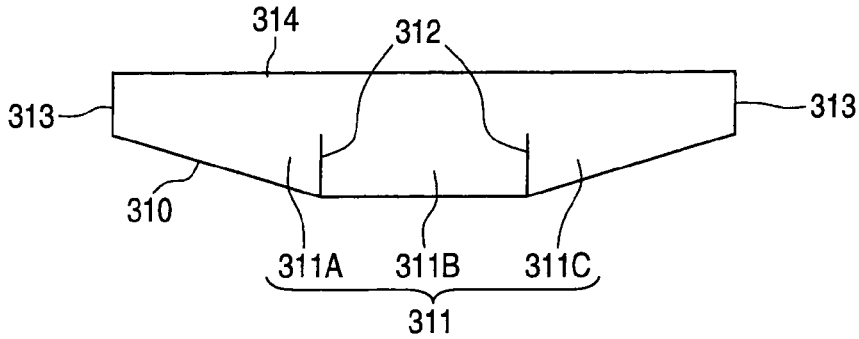

Further, as shown in FIG. 14B, the distal end portion 311 of a delivery agitation blade 310 may be divided into three parts by two slits 312, and among the divided distal end portions 311A, 311B, and 311C, the both extreme distal end portions 311A and 311C may have a mound shape that is inclined toward a proximal end portion 314 as they go from the slit 312 toward an outermost end 313. In such a case, it is possible to form a concave portion with the distal end portion 311B as a bottom surface when making sliding contact with the inside housing.

Figure 14C:
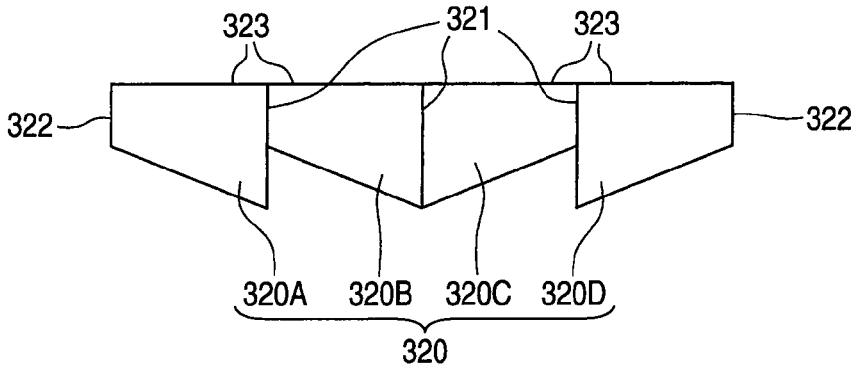

Moreover, as shown in FIG. 14C, slits 321 may be formed such that they are omitted from the distal end of the delivery agitation blade 320 to the proximal end. Additionally, as shown in FIG. 14C, a plurality of delivery agitation blades 320A, 320B, 320C and 320D divided by the slits 321 may have a mound shape that is inclined toward the proximal end portion 323 as they go from one ends to the other ends. In such a case, it is possible to form concave portions between the adjacent blades of the delivery agitation blades 320A, 320B, 320C and 320D when making sliding contact with the inside housing.

Still further, in the above-described exemplary embodiments, the developing device 28 is formed separate from the drum unit 51. Alternatively, the developing cartridge 28 maybe integrally formed with the drum unit 51. In such a case, a process cartridge formed by the developing cartridge 28 and the drum unit 51 that are integrally formed therewith corresponds to the developing device.

Still further, in the above-described exemplary embodiments, the delivery agitation blade 240 has a mound shape, and the slit 243 is formed at a pointy distal end thereof. Alternatively, a rectangular flexible sheet with no slit may be used as the delivery agitation blade. Moreover, a non-flexible delivery agitation blade with no concave portion may be employed.

Still further, in the above-described exemplary embodiments, the present invention is applied to the developer cartridge 100 having the return openings 112 formed therein. Alternatively, the present invention may be applied to a developer cartridge with no return opening. In such a case, developer accumulated toward the supply opening side by the oblique agitation blade can be efficiently conveyed to the supply opening by the support plate portion and the delivery agitation blade.

What is claimed is:

1. A developer cartridge comprising:

a housing that is attachable to and detachable from a developing device and is configured to accommodate developer; and an agitator that is configured to agitate the developer accommodated in the housing and supply the developer to the developing device through a supply opening formed in the housing, wherein the agitator comprises:

a rotation shaft that is rotatably supported by the housing;

a support plate that extends from the rotation shaft to one side in a diameter direction of the rotation shaft;

a delivery agitation blade that is supported by the support plate and is configured to pass through a position opposing the supply opening along an inner surface of the housing by rotation of the rotation shaft, the delivery agitation blade comprising a first end portion, and an entire width of the first end portion being supported by a distal end portion of the support plate; and an oblique agitation blade that is erected from a surface of the support plate and is oblique to the rotation shaft in order to move the developer in an axial direction of the rotation shaft toward the supply opening, wherein the delivery agitation blade comprises a concave portion that is configured to be concave to a backward side in a rotation direction of the rotation shaft during agitation of the delivery agitation blade, wherein the delivery agitation blade comprises a flexible sheet that is configured to make sliding contact with an inner surface of the housing in a bent state, wherein the delivery agitation blade further comprises:

a second end portion; and a slit for dividing the second end portion into plural parts, and wherein when the second end portion makes sliding contact with the inner surface of the housing, the concave portion is formed by different delay amounts between ends of at least both sides of the divided second end portions in the rotation direction.

2. The developer cartridge according to claim 1, wherein the at least both sides of the divided second end portions have a mound shape, in which a distance between the second end portion and the first end portion increases as an outermost end of the delivery agitation blade approaches the slit.

3. The developer cartridge according to claim 1, wherein the at least both sides of the first end portions corresponding to the divided second end portions are supported by a bending adjustment wall so that the bending amount increases as the outermost end of the delivery agitation blade approaches the slit.

4. The developer cartridge according to claim 3, wherein, when the second end portion makes sliding contact with the inner surface of the housing, the concave portion is formed by different delay amounts between ends of the second end portions supported by the bending adjustment wall in the rotation direction.

5. The developer cartridge according to claim 1, wherein the delivery agitation blade further comprises:

a first plate-shaped portion that is inclined toward the backward side in the rotation direction of the rotation shaft as one end side approaches another end side in the axial direction of the rotation shaft; and a second plate-shaped portion that is integrally formed with the first plate-shaped portion and is inclined toward a forward side in the rotation direction of the rotation shaft as the one end side approaches the other end side in the axial direction of the rotation shaft, wherein the second end of the delivery agitation blade is formed along the inner surface of the housing.

6. The developer cartridge according to claim 1, further comprising:

a return opening that is configured to pass the developer from the developing device to the housing, wherein the support plate is notched at a position opposing the return opening and configured to allow the developer flown through the return opening to flow into the housing.

7. The developer cartridge according to claim 6, further comprising:

a support frame that extends from the rotation shaft toward a side opposite to the support plate, wherein a plurality of oblique agitation blades are supported from the second end of the support plate to the distal end of the support frame, and wherein the support frame comprises an opening between a first oblique agitation blade being opposed to the return opening and a second oblique agitation blade being adjacent to the first oblique agitation blade at a side of the return opening.

8. The developer cartridge according to claim 7, further comprising:

a support wall formed by the support plate and the support frame; and a backflow prevention wall that is provided between the supply opening and the return opening and is configured to prevent a back flow of the developer from a side of the supply opening side to the return opening side, wherein the backflow prevention wall is erected in an opposite direction from which the plurality of oblique agitation blades is erected.

9. The developer cartridge according to claim 8, wherein the backflow prevention wall is disposed along an end at the supply opening side of the return opening.

10. The developer cartridge according to claim 1, wherein the oblique agitation blade comprises an opening at an end portion at the rotation shaft side thereof.

* * * * *